United States Patent [19]

Blodee

[11] Patent Number: 4,858,996

[45] Date of Patent: Aug. 22, 1989

[54] MODULAR SEATING

[76] Inventor: Leif Blodee, 293 S. Lakeshore Dr., Holland, Mich. 49423

[21] Appl. No.: 61,102

[22] Filed: Jun. 9, 1987

[51] Int. Cl.[4] ..... A47C 1/12

[52] U.S. Cl. ..... 297/446; 297/232; 403/364

[58] Field of Search ..... 297/232, 446, 445, 420, 297/421, 441, 452, 455, 443; 403/382, 403, 364

[56] References Cited

U.S. PATENT DOCUMENTS

| | | | |
|---|---|---|---|
| 238,491 | 3/1881 | Davis | 403/364 |
| 782,639 | 2/1905 | Bailey | 403/382 |
| 1,098,405 | 6/1914 | Reinecke | 403/382 |
| 3,181,912 | 5/1965 | Nielson | 297/445 |
| 3,313,575 | 4/1967 | Clapp | 297/446 |
| 3,379,474 | 4/1968 | Schwarz, Jr. | 297/420 |
| 3,991,535 | 11/1976 | Keller et al. | 403/364 |
| 4,318,556 | 3/1982 | Rowland | 297/452 |
| 4,431,229 | 2/1984 | Unger | 297/452 X |

FOREIGN PATENT DOCUMENTS

| | | | |
|---|---|---|---|
| 1189766 | 4/1970 | United Kingdom | 297/232 |

*Primary Examiner*—James T. McCall

*Attorney, Agent, or Firm*—Waters, Morse & Harrington

[57] ABSTRACT

Modular seating comprises flat side frame members including chair frames and bench and table frames, with each frame including means to bolt seats and tables to the sides thereof, the units being constructable as free-standing components or as interconnected seats, tables, and benches. The frames are formed of laminations having overlapping laminated joints wherein laminations of intersecting members extend all the way through the joints. The back rest has a frame without a rigid frame member at the top of the back rest.

2 Claims, 6 Drawing Sheets

MODULAR SEATING

BACKGROUND OF THE INVENTION

A wide variety of methods exist for forming joints in constructing furniture, including the use of fasteners such as screws; the use of interfitting grooved joints that are glued together; and the use of dowels that fit into openings. Typical joints where two wood members are butted together at right angles are susceptible to eventual loosening and separation with most furniture construction methods employed today.

An object of the present invention is to provide a furniture construction and method that creates a substantially permanent and rigid interconnection for joints in the furniture pieces.

SUMMARY OF THE INVENTION

In accordance with the present invention, a furniture construction wherein co-planar members are joined together at a joint comprises a series of laminations, with the laminations at the joint alternating between the interfitting members, the joint thus comprising an alternating series of overlapping laminations that are rigidly glued together, with the laminations for each member extending all the way through the joint.

An important feature of the present invention is that the separate plies of wood at the interfitting joints are formed so as to be in contact with each other at a skewed angle, such that pressure applied to the joint while it is drying causes the interfitting members to be wedged tightly together.

A process for fabricating the foregoing furniture comprises laying the individual laminations on a flat work table having upward projections that define the perimeter of the furniture piece. Projections may fit into recesses in portions of the wood laminations lying outside of the profile of the furniture, in order to hold the laminations in a fixed position on the work table. Means for urging the joints tightly into interlocking position are mounted on the work table and can be mechanically or fluid actuated pressure applying mechanism.

Various elements in a furniture construction can be connected together by bolts to form a series of interconnected chairs, a bench, or a combination of chairs and a table, with all of the units being bolted together.

In a chair constructed in accordance with the present invention, another feature is a back rest cushion that is supported by an internal U-shaped frame that leaves the top edge of the cushion resilient and without a rigid edge.

These and other features of the present invention are described below and shown in the appended drawings in accordance with a preferred embodiment of the present invention.

DETAILED DESCRIPTION OF PREFERRED EMBODIMENT

Figure 2:
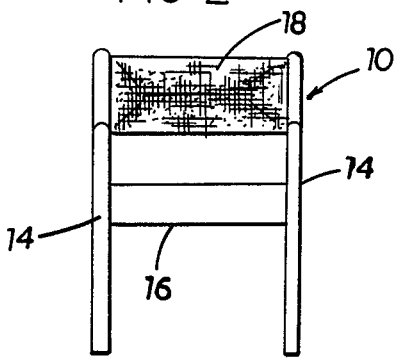
FIG. 2 is a front elevational view of the arm chair of FIG. 1.
Figure 1:
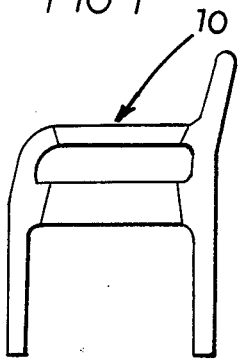
FIG. 1 is a side elevational view of an arm chair of the present invention.
Figure 3:
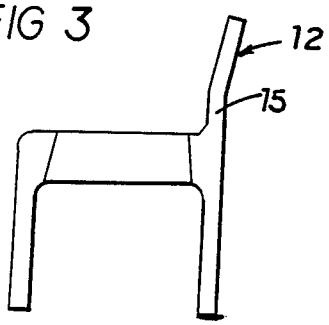
FIG. 3 is a side elevational view of the side chair of the present invention.
Figure 5:
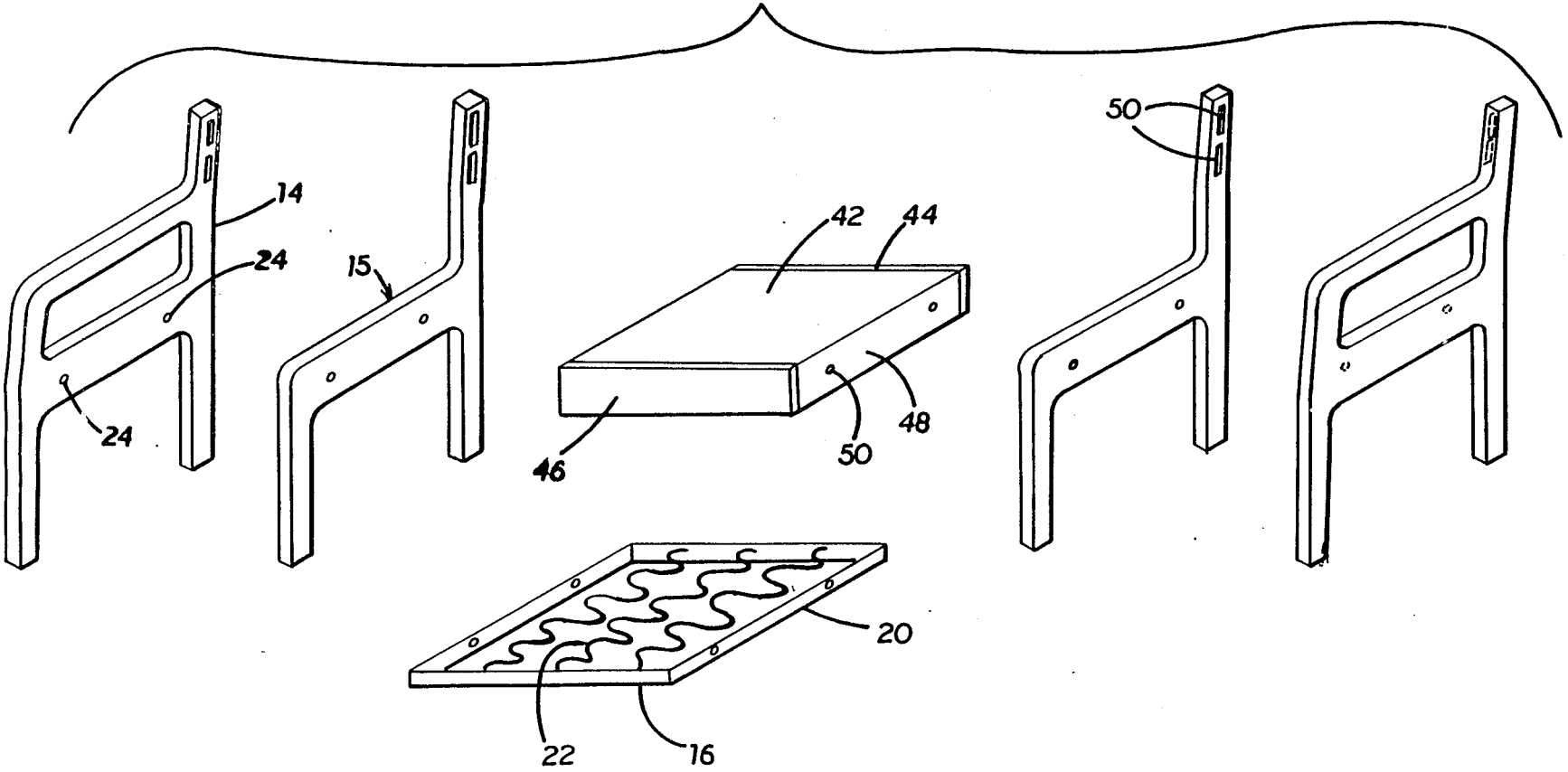
FIG. 5 is an exploded view showing the frame components of an assembly of modular components.

Referring now to the drawings, the present invention comprises modular furniture consisting of a number of individual units. The basic unit is a chair 10 of the type shown in FIGS. 1 and 2. Chair 10 is an arm chair. The same chair can be constructed as a side chair 12 (without an arm) as shown in FIG. 3. Each chair 10 comprises a side member 14, a seat portion 16 suspended between the side portions and a back 18 suspended between the sides. As shown in FIG. 5, the seat 16 comprises a right angle frame 20 having springs 22 suspended between opposite sides of the frame. The frame is bolted to recessed threaded openings 24 in the sides of the chairs.

Figure 6:
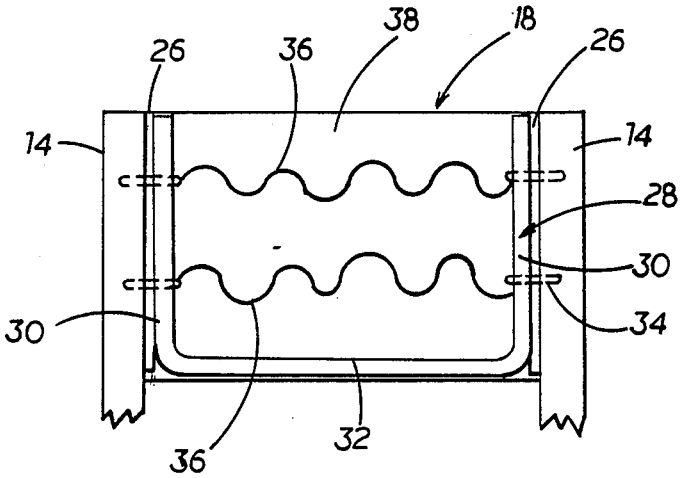
FIG. 6 is a front elevational view of the back of the chair of the present invention, with the cushion portion being broken away to show the frame components.

The construction of back 18 of the chair is shown in FIG. 6. The frame for the back comprises a pair of steel plates 26 that abut sides 14 of the chair. A U-shaped tube 28 having legs 30 and a bottom 32 fits between plates 26. The whole assembly is mounted to sides by means of bolts 34. Springs 36 extend between the legs of the U-shaped support. A foam material 38 is molded around the frame work and the entire cushion is covered with a fabric. The significance of this construction is that the back rest has no rigid frame at the top of the back rest, thus providing a soft cushion, which is more comfortable at this position in the chair. The structure is nonetheless sufficiently rigid to provide adequate strength for the back rest.

Figure 7:
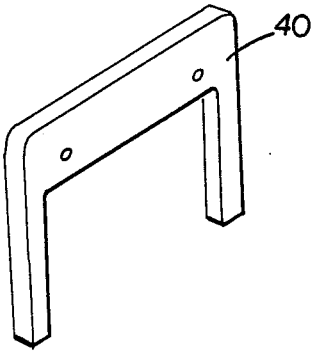
FIG. 7 is a perspective view of the leg construction of the present invention.

In addition to the side chair and arm chair, another basic element in the system is a leg frame 40, which is shown in FIG. 7. The leg frame 40 is formed in exactly the same manner as the lower portion o the arm chair and side chair and serves as an end for a table top 42 (see FIGS. 4 and 5). This frame can be attached to the ends of the table by the same bolt means as the other elements of the system. In addition, frame 40 can be attached to seat frame 20 and a number of units connected together in order to form a bench without any back.

Figure 4:
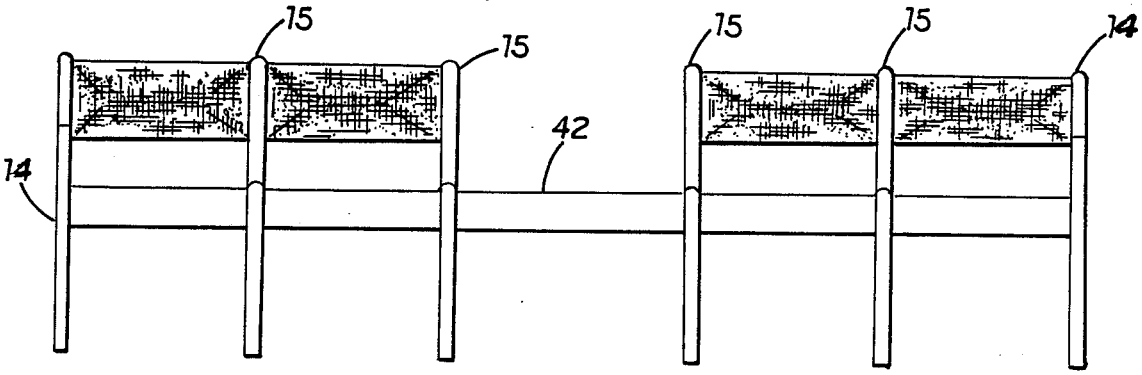
FIG. 4 is a front elevational view of an assembly of modular components of the present invention, including four chairs with a table suspended between the chairs.

Table 42, as shown in FIGS. 4 and 5, comprises a top 44 and depending sides 46 at the front and rear. Depending sides 48 at the sides have openings therein 50 for attaching the table to frame 40 or chair sides 14 (for arm chair connection) or 15 (for side chair connection).

As shown in FIGS. 4 and 5, any number of elements can be bolted together simply to form any combination of structures. In FIG. 4, the assembly comprises two chairs on each side of a table, with a single frame member supporting a unit on each side of the frame member.

The unit in FIG. 4 comprises arm chair end frames 14 with intermediate side chair frames 15 and a central table 42, all of which are bolted together in the same manner. The general construction of these members is shown in FIG. 5, with the bolt openings being shown in these figures. The backs are attached to the frame members by means of conventional fasteners that fit into slotted openings 50 in the side edges of the upper portion of the frames.

Figure 8:
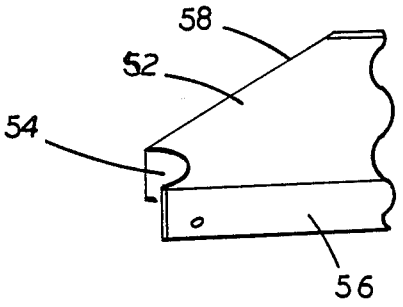
FIG. 8 is a perspective view of a corner top table of the present invention.

If it is desired to construct a modular unit that fits around an outwardly projecting corner, a table 52 of the type shown in FIG. 8 can be employed, with this table having a curved corner 54 that fits over the corner of the room. In this case, the chairs are connected to perpendicular adjacent sides 56 and 58.

Obviously, instead of being connected together, the tables and chairs each can have their own sides and be freestanding units.

Figure 10:
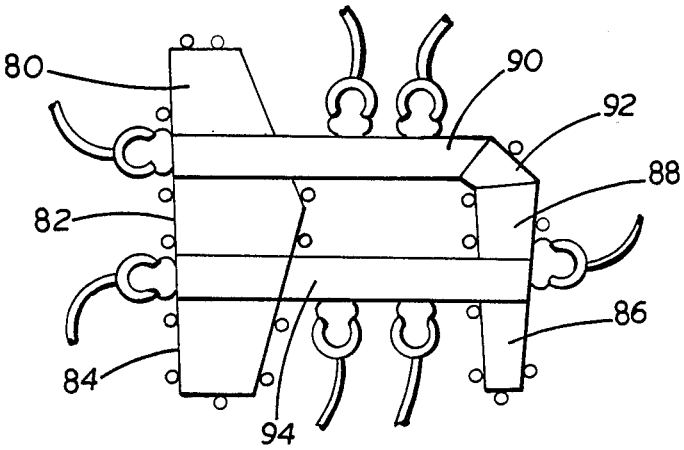
FIG. 10 is a plan view of the fabrication fixture of the present invention, showing the other set of laminations in position.
Figure 11:
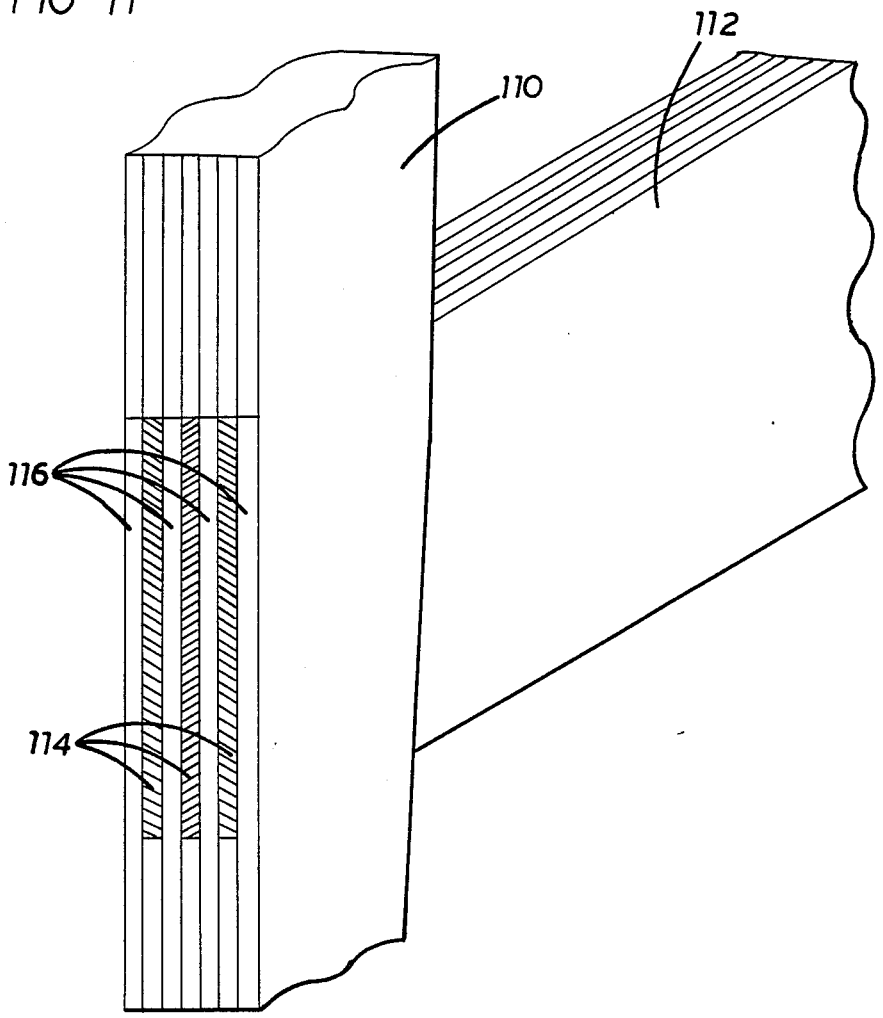
FIG. 11 is a broken view showing a joint of the present invention wherein intersecting structural members are connected.

One of the important features of the present invention is the manner in which the components are constructed. All of the frame members are substantially planar members formed of a series of laminations, with the joints in the structures where structural members interconnect being formed by overlapping and criss-crossing laminations, as shown in FIG. 11. This eliminates the need for mechanical fasteners and provides a glued-laminated joint that is much stronger than dowel-type connectors. The manner of construction of this type of joint is shown in FIGS. 9 and 10.

Figure 9:
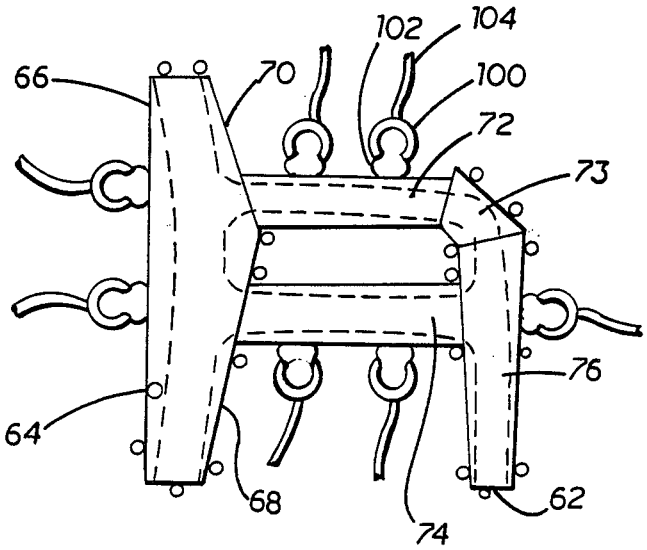
FIG. 9 is a plan view of the fabrication fixture of the present invention, showing one set of laminations in position.

In FIG. 9, a clamping fixture 60 is shown. Clamping fixture 60 comprises a horizontal table having a series of upwardly extending projections 62 that are spaced around the outer periphery of the furniture frame. The projections can be on the outer side of the wood members or they could be positioned inside scrap portions of the wood members, with the wood members having openings therein that fit downwardly on the projections for a rigid fit. An example of such a projection is shown as projection 64 in FIG. 9.

The laminated structures are laid up in two steps. In FIG. 9, one set of matching laminations is laid on to the table inside the projections. This set of laminations includes a back member 66 that has an upwardly and inwardly tapered front surface 68 extending upwardly from the bottom of the leg and a downwardly and inwardly tapered front surface 70 extending downwardly from the top of the back. An arm 72 having a mating tapered surface is positioned adjacent back 66, as is a seat support 74. A front leg 76 extends upwardly into position adjacent seat support 74 and further upwardly to a corner piece 78, which is also tapered to mate with the ends of arms 72 and legs 76.

The manner in which these members are tapered is an important feature of the present invention. As the drawing illustrates, the ends of arm 72 are downwardly and inwardly tapered, such that downward pressure on arm 72 causes the arm to be more tightly wedged between back 66 and corner members 78. Similarily, seat support 74 is upwardly and inwardly tapered, such that upward force on the seat support wedges the seat support between back 66 and leg 76. The top of leg 76 is tapered so that inward force on leg 76 wedges it more tightly against corner piece 78.

Before describing the manner in which the pieces are secured together, reference should be made to FIG. 10, which illustrates how an alternate layer of laminations is laid up in the fixture. The laminations comprise alternate layers of laminations of FIGS. 9 and 10, with the laminations of FIG. 9 being on the outer sides of the frame members.

As shown in FIG. 10, the back comprises an upper section 80, a middle section 82, and a leg section 84. The front leg comprises a lower section 86 and upper section 88. An arm lamination 90 extends all the way through the back and is exposed at the rear of the chair frame. The front end of arm 90 abuts a smaller corner piece 92.

Similarily, a chair support member 94 extends all the way through the back and the front leg of the chair frame, with ends of the laminations being visible on the front and the back of the chair.

After a layer of laminations of the type shown in FIG. 9 ("A" laminations) are laid on the fixture, glue is applied to the laminations and laminations of the type shown in FIG. 10 ("B" laminations) are laid on top of the "A" laminations. Another layer of "A" laminations is then applied and another layer of "B" laminations is applied. This can continue until a final layer of "A" laminations is applied.

An important feature of the present invention is the manner in which all the laminations are locked tightly together so as to form joints having no spaces between them. This can be accomplished mechanically by clamps or the like or it can be accomplished by a cam mechanism incorporated into the positioning projections. Another way of doing this is shown in FIGS. 9 and 10, wherein sections of rigid tube 100 extend upwardly from the table, with open sides of the tubes facing the frame structure. A resilient tube 102 is positioned inside the rigid tube, with the outer surface of the tube extending through the open section so as to be engageable with the furniture frame. An inlet conduit 104 leads to the interior of the resilient tubes and to a source of pressurized air. When air pressure is applied to the interior of the resilient tubes 102, the tubes press outwardly forcing the arm members downwardly and the chair supports upwardly so as to bring them into close engagement with the leg and back of the chair frame. It is also possible to employ pneumatic clamps of this type at the front and back of the chair frame so as to force the legs and backs inwardly, but this may not be essential. When the components have been laid up completely and glued and the arms and seat portions have been pressed inwardly into close approximation to the front and back of the chair frame, a mating plate is placed over the top of the assembly and clamped downwardly, causing the laminations to be pressed together. This also causes the laminations to expand slightly in a horizontal direction, thereby eliminating any further spaces between the side edges of the laminations.

This construction and indeed the same lay up fixture can be used for the table legs and the side chair and arm chair frames.

After the laminated frames have been formed and clamped and set, the frames are then cut to their desired shape, with extra wood on the outer edges of the frame being trimmed away. Openings are then formed in the frame members and metal thread connections are mounted in the openings for attaching the frames to other members by means of bolts.

The interlocking joint construction is shown in FIG. 11. This shows a vertical member 110 attached to a horizontal member 112 by means of overlapping laminations of the type formed by the process shown in FIGS. 9 and 10. In this exemplary figure, three laminations 114 extend through member 110 and are exposed at the outer side thereof, while member 110 includes four laminations 116 that interlock and overlap the laminations 114. This forms a tight joint.

The foregoing is illustrative of the preferred practice of the present invention, but additional modifications and changes in the detail of construction may be made without departing from the spirit and scope of the present invention, as defined in the appended claims.

The embodiments of the invention in which an exclusive property or privilege is claimed are defined as the following:

1. A laminated furniture construction wherein intersecting first and second members are joined together at a joint by overlapping laminations, the first, member being formed of at least two different alternating lamination layers, one lamination layer extending over the joint in the direction of the first member and the second lamination layer leaving an open space at the joint in the direction of the second member, the second member having mating lamination layers, a first layer that leaves an open space at the joint in the direction of the first member and a second layer that extends through the joint in the direction of the second member, the laminations being glued together to form a rigid interlocking joint with the laminations of both members extending all the way through the joint.

2. A furniture construction according to claim 1 wherein adjacent laminations for at least one lamination layer of the first and second members abut each other at inclined angles such that pressure on one member in the direction of the other member causes the members to become tightly wedged.

* * * * *